United States Patent [19]

Ryker et al.

[11] 4,258,552

[45] Mar. 31, 1981

[54] LOAD SHARING SYSTEM FOR MULTIPLE ENGINE POWER PLANTS

[75] Inventors: John Ryker, Lombard; Kenneth D. Gillespie, Lisle, both of Ill.

[73] Assignee: General Motors Corporation, Detroit, Mich.

[21] Appl. No.: 13,733

[22] Filed: Feb. 21, 1979

[51] Int. Cl.[3] ..... F02D 25/00

[52] U.S. Cl. ..... 60/711; 60/710

[58] Field of Search ..... 60/701, 702, 706, 710, 60/711, 716, 719

[56] References Cited

U.S. PATENT DOCUMENTS

| | | | |
|---|---|---|---|
| 2,452,064 | 10/1948 | Mayrath | 60/710 |
| 2,811,017 | 10/1957 | Reiners | 60/710 |
| 3,479,821 | 11/1969 | Mathers et al. | 60/703 |
| 3,479,822 | 11/1969 | Nelson et al. | 60/702 |
| 3,600,888 | 8/1971 | Nethken | 60/39.15 |
| 3,986,363 | 10/1976 | Beaman et al. | 60/702 X |
| 4,124,980 | 11/1978 | Olson et al. | 60/701 X |

FOREIGN PATENT DOCUMENTS

| | | | |
|---|---|---|---|
| 542839 | 1/1977 | U.S.S.R. | 60/701 |

*Primary Examiner*—Allen M. Ostrager
*Assistant Examiner*—Stephen F. Husar
*Attorney, Agent, or Firm*—C. R. Meland

[57] ABSTRACT

A load sharing arrangement for a multiple engine power plant operating to supply power to a common load wherein the power output of each engine is proportional to the amount of fuel supplied thereto. A pneumatic speed setting designated by the power plant operator is directed so as to control the power output of one of the engines (master), and remotely located control system sensitive to the power output of each of the engines, adjusts the power output of the other engine (slave) so that the common load is equally shared at the designated speed setting.

4 Claims, 6 Drawing Figures

LOAD SHARING SYSTEM FOR MULTIPLE ENGINE POWER PLANTS

This invention relates to a load sharing arrangement for a multiple engine power plant driving a common load. More particularly, this invention relates to a load sharing arrangement for power plants utilizing internal combustion engines of the type in which the power output is proportional to the amount of combustion fluid supplied thereto.

One particular application for power plants of this nature is marine propulsion, in which two diesel engines are operated to supply power to a common load, the propeller. The engine output shafts are rigidly interconnected through a single gear box, and the gear box output shaft turns the propeller. As a result, the engines are forced to rotate at the same speed.

Each engine is generally equipped with a pneumatically controlled governor in order to control engine speed and to dampen fluctuations due to transient loading conditions. An air pressure control signal is received by an input port of the governor in order to set the power output of the engine. The air pressure control signal indirectly controls the pressure in a power cylinder of the governor and a piston in the power cylinder is mechanically connected to the engine fuel injector rack. The injector rack length directly controls the amount of fuel supplied to the engine, and the power output of the engine is proportional to the amount of fuel supplied thereto. In this way, the air pressure control signal received by the governor controls the power output of the engine to which it is connected. Due to the characteristics of various governor components, the relationship between the air pressure control signal and the pressure in the power cylinder is nonlinear. Moreover, there is substantial variation from governor to governor due to wide tolerances. To overcome these inherent irregularities, such governors are provided with one or more adjustable set points at which the rack length for a given air pressure control signal is known. That is, the set point is initially set on each engine governor unit by adjusting various internal components of the governor so that for a particular air pressure control signal, the governor will repeatedly generate a certain pressure in the power cylinder, causing a certain engine rack length to be set.

Thus, if two engine governor units are controlled by the same air pressure control signal at a set point, the power output of each engine will be substantially the same. To put it another way, if two engine governor units controlled by a common air pressure control signal were connected to supply power to a common load, the engines would equally share the load when operated at the set point. When the engines are controlled by a common air pressure control signal and operated at a non-set-point, the governor tolerances and nonlinearities alluded to above result in disparate rack lengths (and power outputs) as between the engines. If the engines are connected to supply power to a common load, one engine will be overloaded, and the other underloaded. By overloaded it is meant that the engine in this condition is supplying more than its share of power to the load.

The unbalanced load distribution occurring at non-set-points is an unacceptable mode of operation. Not only is overloading wasteful from an efficiency standpoint, but severe engine damage could result from continued operation in that mode.

One apparent solution to the problem is to provide several governor set points so that the load would be evenly shared at each of the set speeds. However, if an adequate number of set points were provided for a versatile application such as marine propulsion, the governor would be unduly expensive and complex.

The problem of unbalanced loading has been recognized, but prior art load sharing systems have proven to be unreliable in operation. One apparent reason for the lack of reliability is the use of engine or governor mounted rack sensors and equipment, which fail prematurely when subjected to the harsh environment of constant vibration and extreme heat.

Accordingly, it is one object of this invention to provide a reliable load sharing system for a multiple diesel engine power plant which requires no engine or governor mounted equipment.

In carrying this object forward, this invention recognizes that the pressure in the power cylinder of a governor is proportional to the power output of the engine the governor is connected to. Thus, a reliable indication of the power output of each engine may be obtained without the use of engine or governor mounted rack sensors by extending a pressure line from the power cylinder of each of the governors to a remotely located control cabinet wherein pressure-to-voltage transducers generate electrical signals proportional to the pressure in the power cylinder of each governor.

It is another object of this invention to provide a stable electronic control system responsive to the power output of each of two diesel engines for controlling the power output of one of the engines so that they equally share a common load.

In carrying this object forward an electronic comparator responsive to the transducer voltages provides an error signal and a correction signal is generated to adjust the power output of one engine if the error signal exceeds a predetermined amount. A function generator and further comparator act to reduce the power output adjustment that would otherwise be made if the magnitude of the generated function exceeds the magnitude of the error signal. In this way, a stable control is provided and undesirable oscillations (commonly referred to as hunting) are eliminated.

Figure 1:
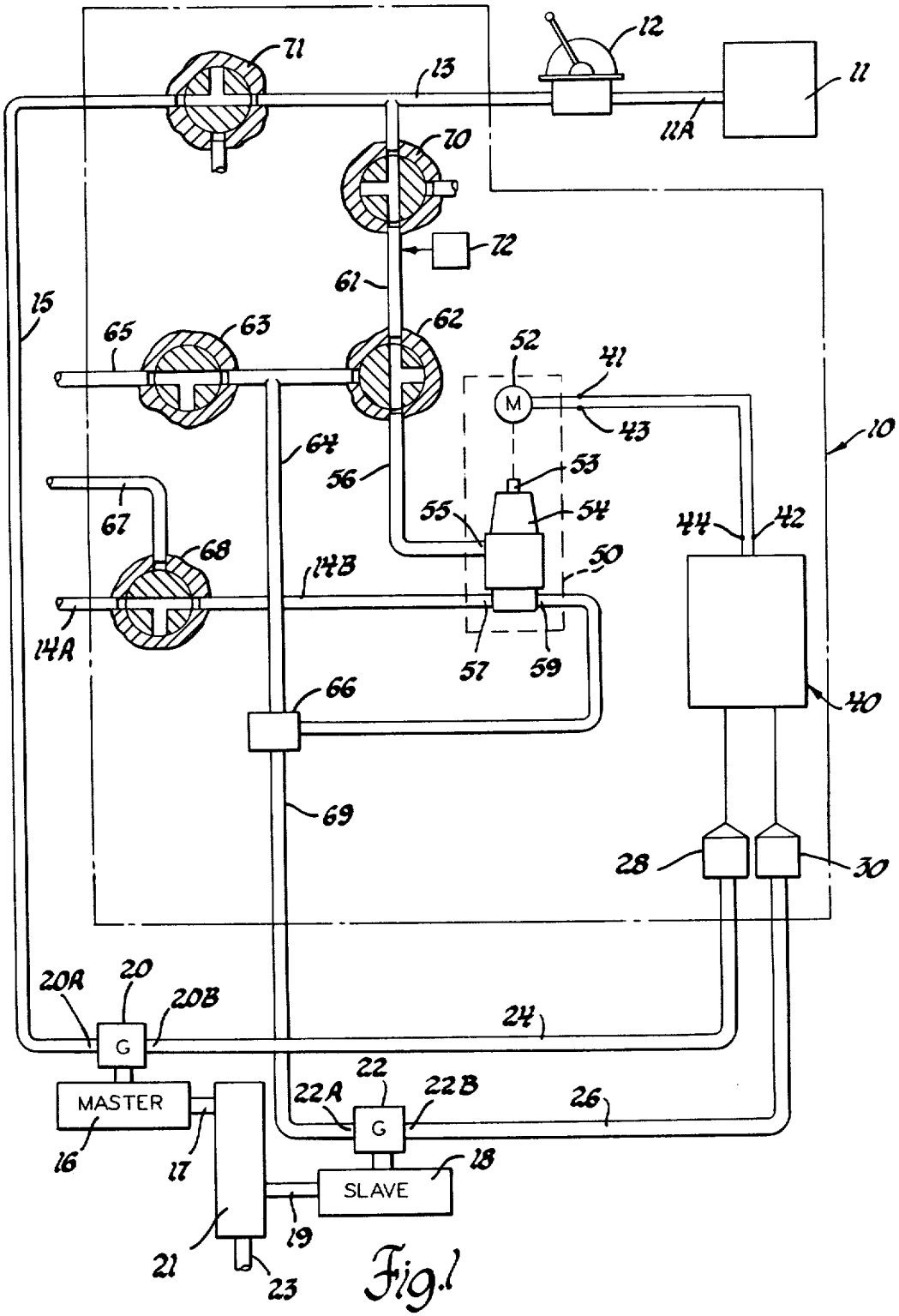
FIG. 1 is a schematic diagram of a load sharing system made in accordance with this invention for a two-engine power plant.

Referring now to the drawings, and more particularly to FIG. 1, reference numeral 10 generally designates a control cabinet located remotely from the engine compartment, and containing the control system equipment. Apparatus external to the control system includes diesel engines 16 and 18; standard pneumatic governors 20 and 22 connected to engines 16 and 18 respectively; manual throttle 12 for setting a master air pressure signal in pressure line 13; and pressure line 15 for applying the master air pressure signal to the input port of governor 20.

The governors 20 and 22 have been illustrated schematically in FIG. 1 since they are conventional devices. Each responds to a control pressure applied to an input port, and the amount of control pressure applied to the port indirectly controls the pressure in a power cylinder that drives a piston (not shown) that in turn operates the injector racks (not shown) of the associated diesel engine. Thus, the power output of each diesel engine is a function of the power cylinder pressure in the associated governor. One type of governor that meets the above stated requirements is the PGA governor manufactured by Woodward Governor Company, Engine & Turbine Controls Division, Ft. Collins, Colo.

Reference numerals 20A and 22A designate the input ports of governors 20 and 22 respectively. Reference numerals 20B and 22B designate ports in communication with the power cylinders of governors 20 and 22 respectively. Control pressures are applied to input ports 20A and 22A via pressure lines 15 and 69 respectively. Ports 20B and 22B are connected to pressure lines 24 and 26 respectively.

Engine output shafts 17 and 19 are connected together through common gear box 21 to rotate gear box output shaft 23 to supply power to a common load which may be, for example, the propeller of a ship. Engine 16 is referred to as the "master engine", since it is controlled directly by the manually set master air pressure signal. Engine 18 is referred to as the "slave engine" since it is controlled by an air pressure signal calculated to result in a power output substantially equal to that of the master engine.

Supply air for throttle 12 is provided via pressure line 11A by source of compressed air 11 and is typically 10 psi or higher. Manual adjustment of throttle 12 serves to set the master air pressure in pressure line 13, which is representative of the desired power output of each of the engines. Numeral 40 generally designates an electronic control module which will be further described in reference to FIGS. 2 and 3. Numeral 50 generally designates a motor operated biasing relay which will be further described in reference to FIG. 5.

The pneumatic elements of the control system comprise shut-off valves 62 and 63, biasing relay 54, shuttle valve 66 and air supply valve 68. Biasing relay 54 is a standard part; a typical device of this type is the Nullmatic Computing Relay Model 680 manufactured by Moore Products Company, Springhouse, Pennsylvania. Biasing relay 54 maintains an adjustable air pressure differential between input port 55 and output port 59, the magnitude and sign of the pressure differential being a function of the angular position of rotatable bias adjust shaft 53. That is, by rotating the bias adjust shaft 53, the output pressure (slave air pressure) may be made less than, equal to, or greater than the input pressure. Supply air is received at port 57 via pressure lines 14A and 14B to operate biasing relay 54; if supply air is removed, the output pressure drops to atmospheric pressure. Pressure line 14A may be connected to pressure line 11A or any other source of compressed air.

When the control system is operational (normal mode), master air pressure is connected to biasing relay 54 and the slave air pressure is connected to the input port of governor 22 via line 69. When the control system is bypassed, master air pressure in line 13 is connected to the input ports of both governors 20 and 22. Air supply valve 68 and shut-off valves 62 and 63 are solenoid controlled by apparatus, not illustrated, so that all valves switch in unison. In FIG. 1, the normal mode position of the valves is shown; in the bypass mode, the valves are rotated 90° in the counter-clockwise direction.

When energized (normal mode), shut-off valve 62 applies master air pressure via pressure lines 61 and 56 to input port 55 of biasing relay 54. When deenergized (bypass mode), shut-off valve 62 applies master air pressure via pressure lines 61 and 64 to an input of shuttle valve 66. Shuttle valve 66 is a standard pneumatic device; it transmits to its output port the higher of two input pressure signals. In the normal mode, the slave air pressure is the higher pressure input signal; in the bypass mode, the master air pressure is the higher pressure input signal. The output port of shuttle valve 66 is connected to the input port of governor 22 via pressure line 69. In this way, shut-off valve 62 and shuttle valve 66 cooperate to connect master air pressure to the input port of governor 22 in the event of an electrical failure or when it is otherwise desired to bypass the load sharing control system.

The operation of air supply valve 68 and shut-off valve 63 will now be explained. In the normal mode, shut-off valve 62 (energized) applies master air pressure to biasing relay 54, air supply valve 68 (energized) applies supply air to biasing relay 54, and shut-off valve 63 (energized) vents pressure line 64 via exhaust pressure line 65. In the bypass mode, shut-off valve 62 (deenergized) bypasses master air pressure to shuttle valve 66, air supply valve 68 (deenergized) vents the supply air input 57 of biasing relay 54 via exhaust pressure line 67, and shut-off valve 63 (deenergized) blocks exhaust pressure line 65. In this way, there is provided at the output of shuttle valve 66 a clean and definite transition from the slave air pressure signal to the master air pressure signal when biasing relay 54 is bypassed. Upon returning to a load sharing mode, shut-off valve 63 is needed to vent pressure line 64 so that master air pressure will not be trapped in pressure line 64. Otherwise, the slave air pressure would be transmitted to the input port of governor 22 only if it exceeded the trapped master air pressure.

Pressure lines 24 and 26 are connected to pressure-to-voltage transducers 28 and 30 respectively and the dc voltages generated by the transducers are applied as inputs to electronic module 40. The pressure-to-voltage transducers are preferably an "off-the-shelf" item, such as National Semiconductor Model #LX1720G. The two output terminals 42 and 44 of electronic module 40 are connected to control terminals 41 and 43 of electric motor 52 of motor operated biasing relay 50.

During start up and idling operations, air pressure switch 72 deenergizes shut-off valves 62 and 63 and air supply valve 68, bypassing the load sharing system. The governors are equipped with a mechanical stop that maintains the engine at idling speed when the control pressure applied to the input port drops below a predetermined amount. Low pressure switch 72 detects this pressure in pressure line 61 and prevents the load sharing system from attempting to make corrections since the air pressure signals do not control engine speed under these conditions.

The control system may also include control shut-off valves 70 and 71, illustrated in the normal mode position in FIG. 1. These valves may be independently operated to cut off the master or the slave air pressure signal when it is desired to operate only one of the engines. The valves may also be used as will later be described when the control system of this invention is operated for load sharing among more than two engines. To cut off the slave air pressure signal in pressure line 69, shut-off valve 70 is rotated counterclockwise 90° venting pressure line 61 to atmospheric pressure. Similarly, to cut off the master air signal in pressure line 15, shut-off valve 71 is rotated counterclockwise 90° venting that line and blocking the master air pressure signal. Shut-off valves 70 and 71 may be controlled individually by electrically energizable apparatus, not illustrated. Both valves 70 and 71 are shown in the deenergized mode.

Figure 2:
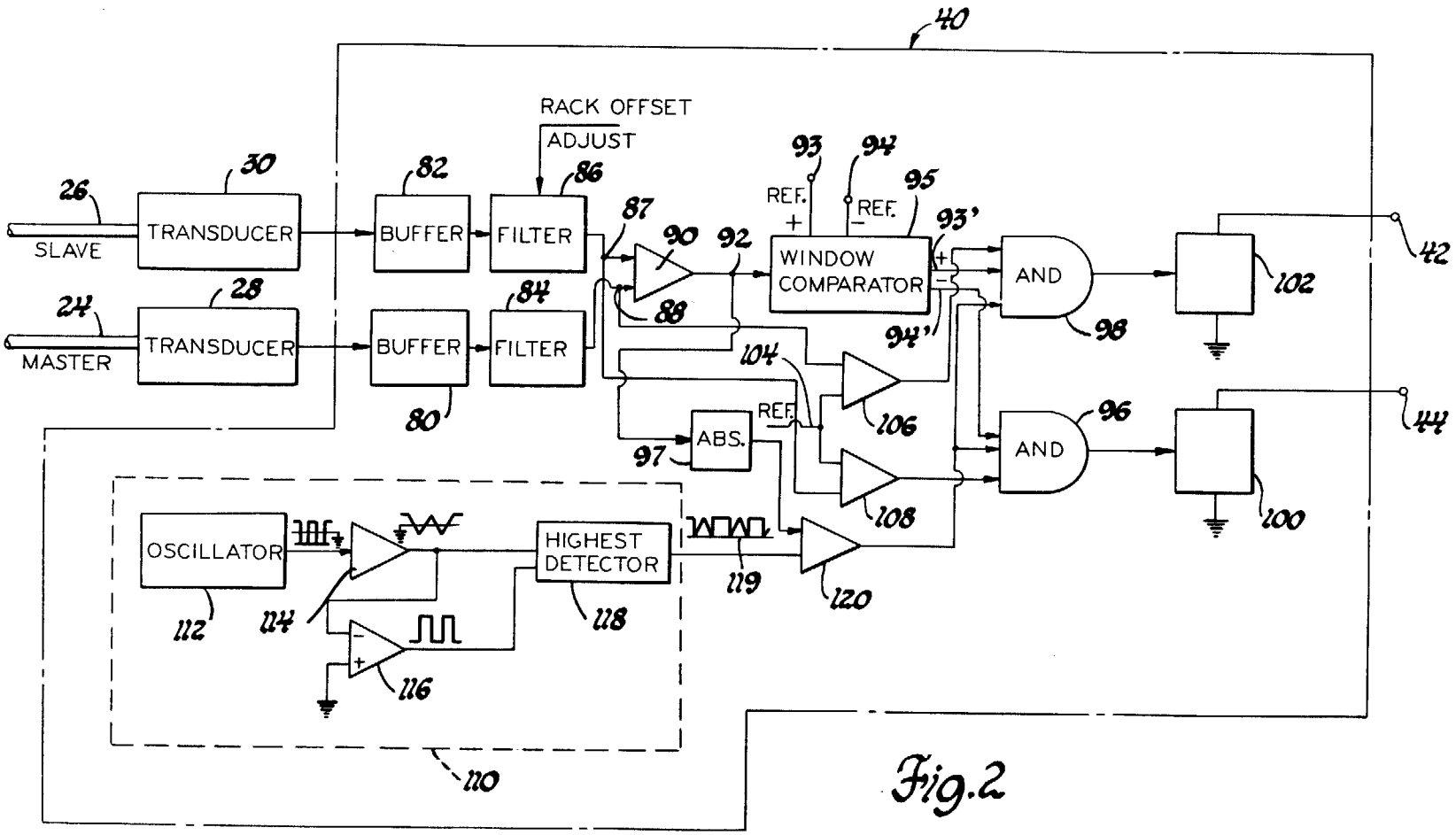
FIG. 2 is a block diagram of the electronic module of the invention.

Referring now to FIG. 2, reference numeral 40 designates the electronic module shown in FIG. 1. The electronic module receives as inputs the dc voltage outputs from pressure-to-voltage transducers 28 and 30. The voltage output of transducer 28 is connected to buffer 80, the output of which is connected to filter 84, the output of which is connected to junction 88. Similarly, the voltage output of transducer 30 is connected to buffer 82, the output of which is connected to filter 86, the output of which is connected to junction 87. Buffers 80 and 82 isolate transducers 28 and 30 from the other circuit elements as a protective precaution. Filters 84 and 86 average the transducer output voltages to smooth out any undesired transient pressure response in the governor power cylinders.

A rack offset adjustment is provided on filter 86 to adjust the voltage at junction 87 in order to compensate for tolerance variations between the governor power cylinders, if necessary. That is, an equal pressure in each of two governor power cylinders will not necessarily thereby result in equal injector rack lengths. The offset, however, is substantially constant and can be easily corrected by the offset adjustment. This adjustment, if necessary, is the only installation adjustment to be made.

Junctions 87 and 88 are connected as inputs to comparator 90, the output of which is connected to junction 92. The signal appearing at junction 92 thus represents the difference between the power outputs of the master and slave engines, and will therefore be referred to in later discussion as the "error signal". The error signal is connected to the input of window comparator 95 wherein it is compared to positive reference voltage 93 and negative reference voltage 94. Window comparator 95 has a positive output terminal 93' which is energized if the error signal is more positive than positive reference voltage 93 and a negative output terminal 94' which is energized if the error signal is more negative than negative reference voltage 94. Obviously, positive output terminal 93' and negative output terminal 94' may not be energized at the same time. Negative output terminal 94' is connected to one input of three-input AND gate 96 and positive output terminal 93' is connected to one input of three-input AND gate 98. The output of AND gate 96 is connected to the input of control switch 100, the output of which is connected to terminal 44. Similarly, the output of AND gate 98 is connected to the input of control switch 102 the output of which is connected to terminal 42. When energized, control switches 100 and 102 operate to connect their respective output terminals to ground potential. The error signal is connected to the input of absolute value generator 97 which merely inverts input voltages that are negative in sign so that the output voltage is equal to the absolute value or magnitude of the input error signal. The output voltage of absolute value generator 97 is connected as an input to comparator 120. Reference numeral 110 generally designates a function generator comprising oscillator 112, integrator 114, comparator 116, and highest detector 118. The trace shown to the right of each element of function generator 110 represents the voltage signal appearing at the output of that element. The output voltage 119 of function generator 110 is continuously applied as an input to comparator 120, the output of which is applied as an input to both AND gates 96 and 98. The output of comparator 120 is energized when the absolute value of the error signal at junction 92 exceeds the value of generated function 119. It should be apparent that as the magnitude of the error signal decreases, the output of comparator 120 is energized less often.

Junction 87 is connected as an input to overpressure comparator 108, and junction 88 is connected as an input to overpressure comparator 106. Reference voltage 104 is supplied as an input to both comparator 106 and 108. The output of comparator 108 is connected as an input to AND gate 96 and the output of comparator 106 is connected as an input to AND gate 98. Comparators 106 and 108 are energized whenever reference voltage 104 exceeds the other input voltage. Reference voltage 104 is chosen in order to identify the situation in which either fuel injector rack is fully open. This indicates either a failure or, more likely, a transient loading condition. In either case, comparators 106 or 108 prevent further adjustment by the control system.

Figure 3:
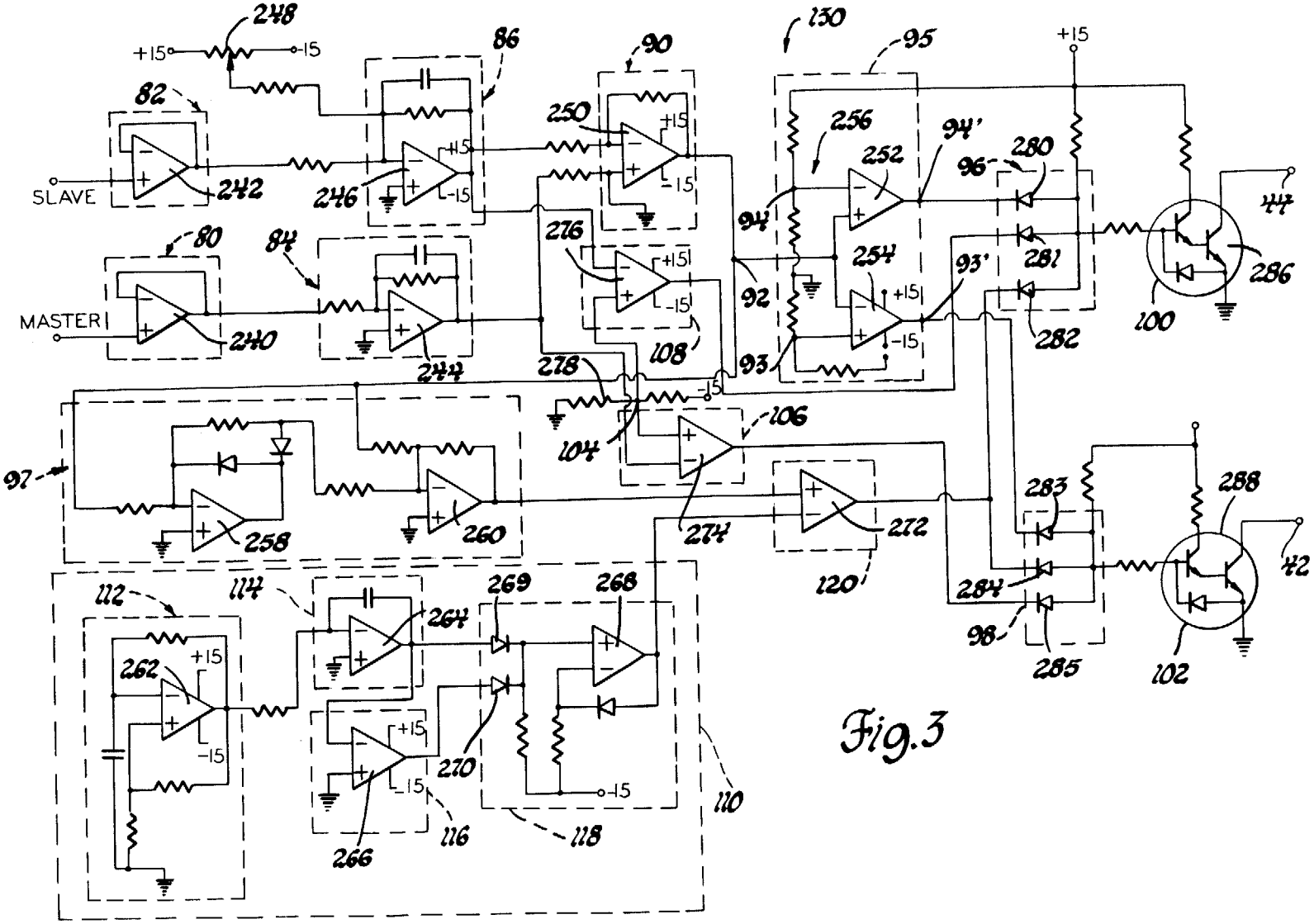
FIG. 3 is a circuit diagram of the electronic module shown in FIG. 2.

Referring now to FIG. 3, reference numeral 130 generally designates the preferred embodiment of electronic module 40. The dashed boxes outline circuit elements that perform the function of the block elements depicted in FIG. 2, and the same reference numerals are used in both Figures to identify corresponding block elements. Since the operation of the circuitry illustrated in FIG. 3 will be well known to those skilled in the art, only a brief description is given.

Operational amplifiers 240 and 242 perform the function of buffers 80 and 82 respectively. Operational amplifiers 244 and 246 perform the function of filters 84 and 86 respectively. Potentiometer 248 performs the function of the rack offset adjustment on filter 86. Operational amplifier 250 performs the function of comparator 90 and the resulting error signal appears at junction 92. Operational amplifiers 252 and 254 along with resistance divider network 256 perform the function of window comparator 95. Positive and negative reference voltages 93 and 94 are provided by resistance divider 256. Positive output terminal 93' is provided at the output of operational amplifier 254 and negative output terminal 94' is provided at the output of operational amplifier 252. Absolute value generator 97 comprises operational amplifiers 258 and 260 for passing positive error signals and inverting negative error signals. Function generator 110, as already described, comprises oscillator 112, integrator 114, comparator 116, and high detector 118. Operational amplifier 262 and its associated passive elements perform the function of oscillator 112; operational amplifier 264 performs the function of integrator 114; operational amplifier 266 performs the function of comparator 116; and operational amplifier 268 together with diodes 269 and 270 perform the function of highest detector 118. Operational amplifier 272 performs the function of comparator 120. Operational amplifier 274 performs the function of overpressure comparator 106 and operational amplifier 276 performs the function of overpressure comparator 108; resistance divider 278 generates the fixed reference voltage 104. AND gate 96 comprises diodes 280, 281 and 282; AND gate 98 comprises diodes 283, 284 and 285. Darlington connected transistors 286 and 288 perform the function of control switches 100 and 102 respectively. Output terminal 42 is provided at the collector terminal of transistor 288 and output terminal 44 is provided at the collector terminal of transistor 286.

The operational amplifiers illustrated in FIG. 3 are preferably off the shelf items such as Motorola MC 1558.

Figure 5:
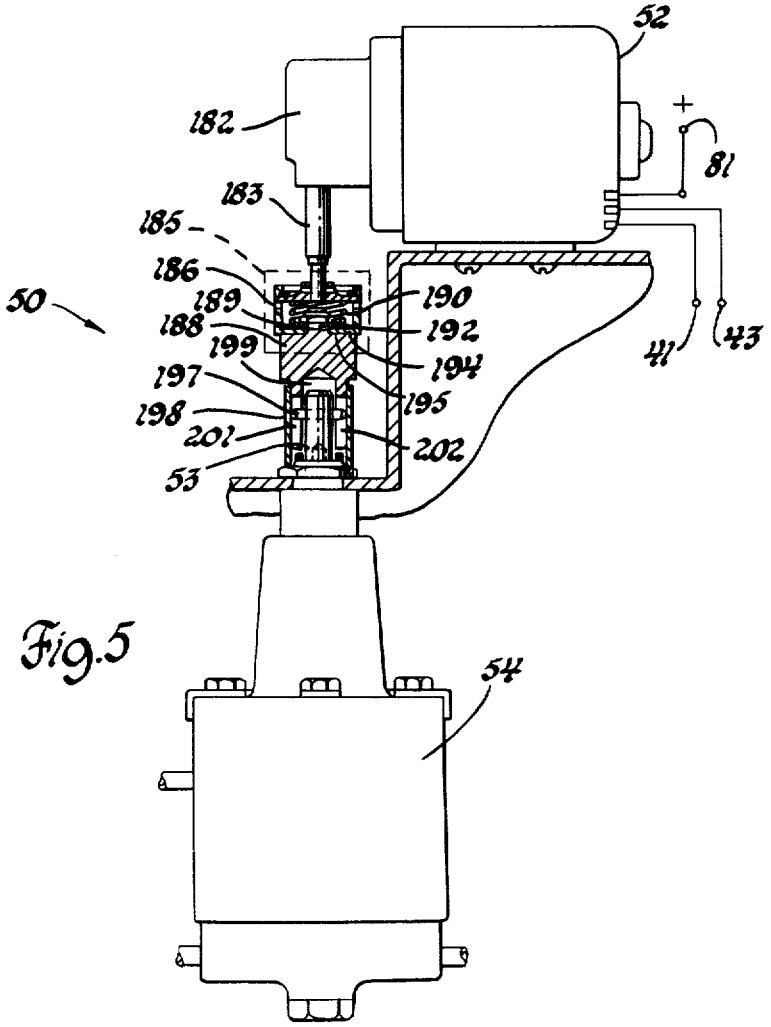
FIG. 5 is an illustration of a motor operated biasing relay.

Referring now to FIG. 5, reference numeral 50 generally designates the motor operated biasing relay of the invention. Bias adjust shaft 53 of biasing relay 54 is rotated by electric motor 52 through friction coupling 185. Reduction gear box 182 reduces the output shaft speed of motor 52 by a factor of 1120, so that output shaft 183 may rotate bias adjust shaft 53 at a controllable rate. Friction coupling 185 comprises driving member 186 which is fixed to output shaft 183; driven member 188, which is fixed to bias adjust shaft 53; Belleville washer 189 which is seated against the lower portion of driving member 186; spring 190, which is in compression between Belleville washer 189 and the upper portion of driving member 186; and nut 192 which is fastened against Belleville washer 189 to the upper end of driven member 188. The mating portions of driving member 186 and driven member 188 have friction coupling surfaces 194 and 195 respectively. The friction surfaces are drawn together by nut 192, which is tightened onto driven member 188 so as to permit a predetermined amount of torque to be transferred through coupling 185 before slippage occurs. The purpose of friction coupling 185 is to prevent damage to the motor or biasing relay should biasing relay 54 bind up for any reason. In such a situation, friction surfaces 194 and 195 would slip, averting damage to any of the system components. Furthermore, friction coupling 185 permits bias adjust shaft 53 to be rotated manually (by rotating driven member 188) in the event of electrical failure or when otherwise necessary to manually balance the power output of the engine. Driven member 188 is fixed to bias adjust shaft 53 by pin 197, which is held in place by pipe 198. Opening 199 is provided for axial movement of bias adjust shaft 53 as it is rotated by motor 52. Similarly, slots 201 and 202 are provided in driven member 188 for the accompanying movement of pin 197. Motor 52 is a standard dc motor having an armature winding and a center-tapped field winding wherein the armature winding is connected between terminal 81 and the tap, and the field winding ends are connected to terminals 41 and 43. Terminal 81 is connected to a positive source of dc voltage, and terminals 41 and 43 are connected to control signal terminals 42 and 44 of electronic module 40 respectively. The motor will rotate so as to adjust the bias of biasing relay 54 in a positive direction if motor control terminal 41 is connected to ground potential. Similarly, the motor will adjust the bias in a negative direction if motor control terminal 43 is connected to ground potential.

Figure 4:
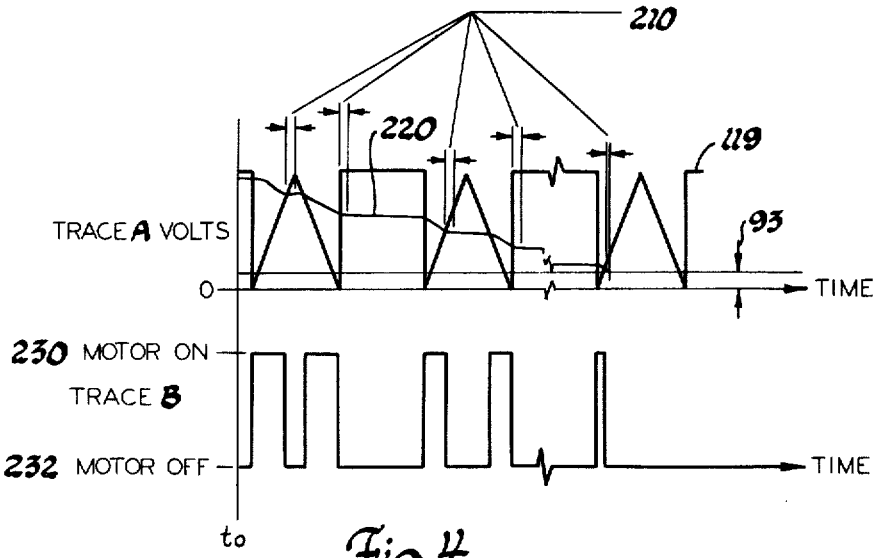
FIG. 4 is a time based diagram illustrating various control system voltages in response to an overloading condition.

Referring now to FIG. 4, trace A and trace B illustrate the relationship between various control system signals on a common time base. In trace A, reference numeral 119 represents the waveform generated by function generator 110, and reference numeral 93 represents the positive reference voltage of window comparator 95. The absolute value of an error signal as generated at the output of absolute value generator 97 is designated in trace A by reference numeral 220. Trace B illustrates the corresponding on-time and off-time of electric motor 52. On the vertical axis, level 230 represents energization of electric motor 52; level 232 represents deenergization. As indicated in reference to FIGS. 2 and 3, three conditions must be met in order to energize electric motor 50. First, neither of the engine fuel injector racks may be fully opened; second, error signal 220 must be more positive than reference voltage 93 or more negative than reference voltage 94, and third, the absolute value of error signal 220 must exceed waveform 119 generated by signal generator 110. Accordingly, it can be seen in FIG. 4 that the motor on-time pulses begin when each of the above conditions are met (assuming neither injector rack is fully opened) and end when at least one of the conditions is no longer met. Reference numeral 210 represents the time periods during which output shaft 183 of motor 52 coasts following deenergization of the motor. The motor on-time pulse width, and hence, motor coast-time 210 decreases as the error signal decreases toward the window comparator voltage range defined by reference voltages 93 and 94. The significance of this relationship will be later described in reference to the operation of the load sharing system.

It should be noted that the error signal shown in trace A of FIG. 4 represents only the magnitude or absolute value of an error signal. That is, error signal 220 is representative of either a positive or a negative error signal as would be observed as junction 92. Accordingly, only reference voltage 93 need be shown in order to compare the error signal voltage to the window comparator voltage range.

The operation of the load sharing system will now be described in some detail. When the system is operational the master air pressure signal from throttle 12 is applied to governor 20 of master engine 16 via line 15 and the slave air pressure from biasing relay 54 is applied to governor 22 of slave engine 18 via line 69. The voltage output of transducers 28 and 30 are representative of the power output of master engine 16 and slave engine 18 respectively. Should the power output of master engine 16 exceed that of slave engine 18, an error signal of positive sign will be generated at junction 92 of electronic module 40. If the error signal exceeds positive reference voltage 93, one input (positive output terminal 93' of window comparator 95) of AND gate 98 will be energized. Whenever the absolute value of the error signal exceeds the voltage of waveform 119, a second input (from comparator 120) of AND gate 98 will be energized. Unless the master engine fuel injector rack is fully opened the third input (from comparator 106) of AND gate 98 will be energized. With each of the above inputs energized, the output of AND gate 98 will energize switch 102 connecting output terminal 42 to ground potential. Electric motor 52 will thereby be energized to rotate bias adjust shaft 53 of biasing relay 54 in a direction to increase the pressure differential between the output and input of biasing relay 54. The increased pressure at the output of biasing relay 54 is applied to governor 22 of slave engine 18 causing the power output of the slave engine to increase. The increase in power output of slave engine 18 increases the voltage at the output of pressure-to-voltage transducer 30. The error signal at junction 92 of electronic module 40 is thereby decreased to a voltage less than positive reference voltage 93 of window comparator 95 and no further corrections are made.

Similarly, if the power output of slave engine 18 exceeds that of master engine 16, an error signal that is negative in sign is generated at junction 92. If the error signal is more negative than negative reference voltage 94 one input line (from negative output terminal 94' of window comparator 95) of AND gate 96 is energized. As before, whenever the absolute value of the error signal exceeds the voltage of waveform 119, a second input (from comparator 120) of AND gate 96 is energized. Unless the injector rack of slave engine 18 is fully opened, the third input (from comparator 108) of AND gate 96 is energized. When all three inputs to AND gate 96 are energized, switch 100 is energized to connect output terminal 44 to ground. Electric motor 52 is thereby energized to rotate bias adjust shaft 53 of biasing relay 54 in an opposite direction to decrease the pressure differential between the output and the input of biasing relay 54. The decreased output pressure of biasing relay 54 is applied to governor 22 of slave engine 18 causing the power output of that engine to decrease. The decrease in power output of slave engine 18 decreases the output voltage of pressure-to-voltage transducer 30 and the error signal at junction 92 thereby decreases to a voltage that is less negative than negative reference voltage 94 of window comparator 95.

Whenever the error signal is within positive reference voltage 93 and negative reference voltage 94 of window comparator 95, the power output of the master and slave engines are substantially the same. This voltage range is commonly known as a deadband and the control system will not operate to correct an error signal within this range.

Were it not for function generator 110, the error signal would tend to oscillate about the deadband of window comparator 95, especially if the deadband were narrow. This instability is commonly referred to as hunting and in this system it is caused primarily by motor inertia. Thus, when motor 52 is deenergized after correcting for an error signal outside the deadband, the output shaft of the motor will coast, tending to drive the error signal through the deadband so that an error signal of the opposite polarity will appear at junction 92. Without function generator 110 and its associated circuitry, the control system would attempt a correction in the opposite direction and so on. The comparison of the absolute value of the error signal with waveform 119 prevents this problem, as can be seen in trace B of FIG. 4, by decreasing the on-time of motor 52 as the error signal decreases. That is, the control system corrects less and less as the error signal approaches the deadband range. Moreover, the motor coast time decreases as the motor on-time pulse width decreases. It is thus very unlikely that the error signal will be driven through the deadband as a result of a control system correction. This feature has the additional advantage of increasing the life of the motor.

Figure 6:
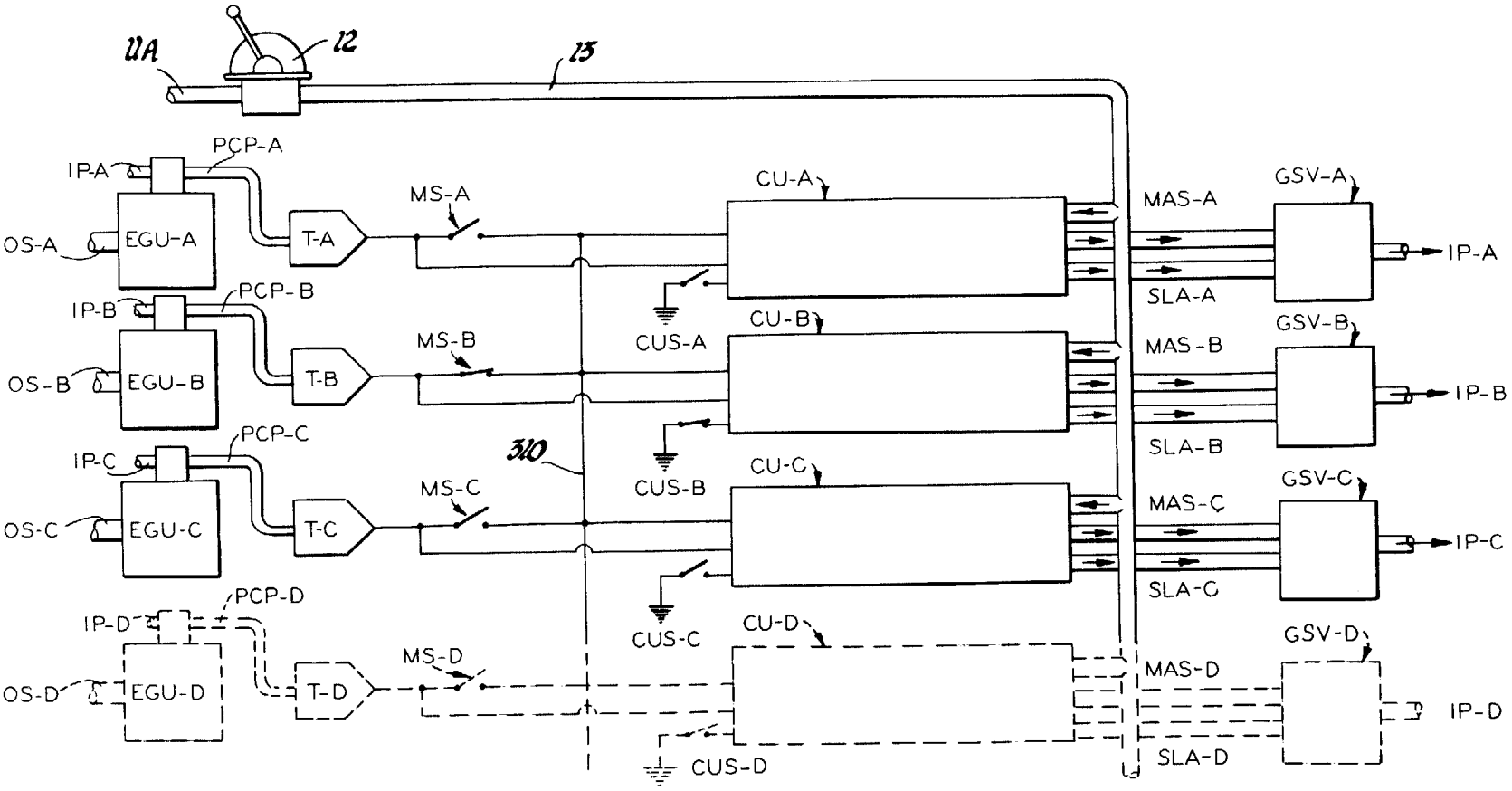
FIG. 6 is a schematic diagram of a load sharing system made in accordance with this invention for a power plant having more than two engines.

Thus far, the load sharing system of this invention has only been described as applied to a two engine power plant. It is, however, equally applicable to power plants in which three or more engines are connected to drive a common load. A load sharing system for such a power plant must enable the operator to select any one of the engines to operate as the master engine. The load sharing system controls each of the remaining engines so that the load is shared equally among all of the engines at any speed setting designated by the operator. FIG. 6 illustrates one way in which the load sharing system of this invention could be implemented for power plants having more than two engines. A diesel engine power plant having three engine-governor units (EGU) is shown. The letters A-C are used as a suffix to identify the elements associated with the corresponding engine governor unit. As in the other figures, each engine has an output shaft (OS) and each governor has an input port (IP) and a power cylinder port (PCP). The power cylinder port of each governor is connected to the corresponding pressure-to-voltage transducer (T). Each engine-governor unit is also associated with a control unit (CU), a master switch (MS), a control unit switch (CUS), and a governor shuttle valve (GSV). Each control unit contains the same elements as control cabinet 10 shown in FIG. 1, excluding pressure-to-voltage transducers. The control unit switches, the master switches and the governor shuttle valves enable the operator to choose any one engine as master. As in FIG. 1, each control unit receives a master air pressure signal from pressure line 11A and throttle 12 via pressure line 13. Also, a master air pressure line (MAS) (corresponding to pressure line 15 in FIG. 1) and slave air pressure line (SLA) (corresponding to pressure line 69 in FIG. 1) is connected to the output of each control unit. Each control unit receives two input voltages: one from its associated pressure-to-voltage transducer, and one from whatever signal is connected to bus conductor 310. The output voltage of any one transducer may be connected to bus conductor 310 by closing the appropriate master switch.

The governor shuttle valves are equivalent to shuttle valve 66 described in reference to FIG. 1. Each receives a master pressure line and a slave pressure line from the corresponding control units; whichever is greater appears at the output. The output of each governor shuttle valve is connected to the input port of the corresponding governor, as indicated. The control unit switches (CUS) operate control valves such as those designated in FIG. 1 by reference numerals 70 and 71. If the control unit switch is closed, a valve such as shut-off valve 70 disables the slave air pressure at the output of the control unit and a valve such as shut-off valve 71 allows the master air pressure signal to be sent to the associated governor shuttle valve. If the control unit switch is open, the valve such as shut-off valve 70 allows a slave air pressure signal to be sent to the governor shuttle valve and the valve such as shut-off valve 71 disables the master air pressure signal at the output of the control unit.

To select a particular engine as master, the operator must close the master switch (MS) and the control unit switch (CUS) associated with that engine. For convenience, the switches shown in FIG. 6 are positioned so as to choose engine B as master. Thus, control unit A generates a slave air pressure based on the difference in power output between engines A and B and control unit C generates a slave air pressure based on the difference in power output between engines C and B. Control unit B transmits only the master air pressure signal; control units A and C transmit only a slave air pressure signal. Engine B is thus controlled by the master air pressure signal and engines A and C are controlled by slave air pressure signals developed in control units A and C respectively.

The above described design concept may be extended as indicated (D) to accommodate power plants having any number of engines driving a common load. There are, of course, many ways in which the load sharing system of this invention may be applied to power plants having more than two engines and the circuit shown in FIG. 6 serves merely as an illustration of how such a system might be designed.

Although the load sharing system of this invention was described primarily in reference to marine propulsion, it should be clear that this invention may be used for other applications as well.

The embodiments of the invention in which an exclusive property or privilege is claimed are defined as follows:

1. A load sharing arrangement for a multiple engine power plant comprising:

first and second internal combustion engines of the type in which the power output is a function of the amount of fuel supplied thereto;

means for connecting said first and second engines to supply power to a common load;

first and second governors connected to said first and second engines respectively wherein each governor is of the type in which a fluid pressure control signal controls the pressure in a power cylinder thereof which in turn controls the supply of fuel to the engine said governor is connected to;

first and second transducers responsive to the pressure in said power cylinders of said first and second governors respectively for generating first and second voltages proportional to the power output of said first and second engines respectively;

means for generating a first fluid pressure control signal indicative of the desired power output of said engines;

means connecting said first fluid pressure control signal to said first governor for setting the power output of said first engine;

means responsive to said first and second voltages for generating a first or second correction signal indicative of the relative magnitude of said first and second voltages;

a bi-directional electric motor having an output shaft;

means applying said correction signals to said motor so that the position of said output shaft is varied in accordance with said first or second correction signals;

and means responsive to the position of the output shaft of said bi-directional motor for generating a second fluid pressure control signal modified from said first fluid pressure control signal and connected to said second governor for controlling the power output of said second engine so as to cause the power outputs of said first and second engines to be substantially equal.

2. A load sharing arrangement for a multiple diesel engine power plant comprising:

a master diesel engine and at least one slave diesel engine connected to supply power to a common load;

governor means connected respectively to said master engine and to said slave engine wherein each governor means is of the type in which a fluid pressure control signal applied to an input port of said governor controls the pressure in a power cylinder thereof which in turn controls the supply of fuel to the engine said governor is connected to;

transducing means responsive to the pressure in the power cylinder of a respective governor for generating voltages proportional to the power output of each of said engines;

means generating a master fluid pressure control signal indicative of the desired power output of each of said engines;

means connecting said master fluid pressure control signal to said input port of said governor means connected to said master engine for setting the power output of said master engine;

comparator means connected to said transducing means for comparing said voltage proportional to the power output of said master engine with said voltage proportional to the power output of said slave engine and for generating an error signal as a function of the difference in said voltages;

means connected to said comparator means for generating a correction signal if said error signal is not within a deadband range defined by first and second reference voltages;

pressure varying means connected to said master fluid pressure control signal generating means and including electrically energizable means responsive to said correction signal for generating a second fluid pressure control signal;

and means for applying said second fluid pressure control signal to said input port of said governor means connected to said slave engine for controlling the power output of said slave engine so as to cause the power output of said slave engine to be substantially the same as the power output of said master engine.

3. A load sharing arrangement for a multiple diesel engine power plant comprising:

a master diesel engine and at least one slave diesel engine connected to supply power to a common load;

governor means connected respectively to said master engine and to said slave engine wherein each governor means is of the type in which a fluid pressure control signal applied to an input port of said governor controls the pressure in a power cylinder thereof which in turn controls the supply of fuel to the engine said governor is connected to;

transducing means responsive to the pressure in the power cylinder of a respective governor for generating voltages proportional to the power output of each of said engines;

means generating a master fluid pressure control signal indicative of the desired power output of each of said engines;

means connecting said master fluid pressure control signal to said input port of said governor means connected to said master engine for setting the power output of said master engine;

comparator means connected to said transducing means for comparing said voltage proportional to the power output of said master engine with said voltage proportional to the power output of said slave engine and for generating an error signal as a function of the difference in said voltages;

means connected to said comparator means for generating a correction signal comprised of a series of current pulses if said error signal is not within a deadband range defined by first and second reference voltages, said last named means including means for reducing the pulse width of said current pulses as the magnitude of said error signal decreases;

pressure varying means connected to said master fluid pressure control signal generating means and including electrically energizable means responsive to said correction signal for generating a second fluid pressure control signal;

means for applying said second fluid pressure control signal to said input port of said governor means connected to said slave engine for controlling the power output of said slave engine so as to cause the power output of said slave engine to be substantially the same as the power output of said master engine.

4. A load sharing arrangement for a multiple engine power plant comprising:

first and second diesel engines, power output of which is a function of the amount of fuel supplied thereto;

means connecting said first and second engines to supply power to a common load;

first and second governors connected respectively to said first and second engines wherein each governor is of the type in which a fluid pressure control signal controls the pressure in a power cylinder thereof which in turn controls the supply of fuel to the engine said governor is connected to;

first and second transducers responsive to the pressure in power cylinders of said first and second governors respectively for generating first and second voltages proportional to the power output of said first and second engines;

means for generating a first fluid pressure control signal indicative of the desired power output of said engines;

means connecting said first fluid pressure control signal to said first governor for setting the power output of said first engine;

comparator means responsive to said first and second voltages for generating an error signal as a function of the difference in said voltages;

means connected to said comparator means for generating a first or second correction signal comprised of a series of current pulses if said error signal is not within a deadband range defined by first and second reference voltages, said last named means including means for reducing the pulse width of said current pulses as the magnitude of said error signal decreases;

a bi-directional electric motor having an output shaft;

means applying said correction signals to said motor so that said output shaft is driven in one direction by said first correction signal and in an opposite direction by said second correction signal;

and means responsive to the position of said output shaft of said motor for generating a second fluid pressure control signal modified from said first fluid pressure control signal and connected to said second governor for controlling the power output of said second engine so as to cause the power outputs of said first and second engines to be substantially equal.

* * * * *